US007523510B1

(12) United States Patent
Biagi et al.

(10) Patent No.: US 7,523,510 B1
(45) **Date of Patent: *Apr. 28, 2009**

(54) SANITARY PLUNGER

(75) Inventors: Daniel Biagi, 2945 Wingate St., Eugene, OR (US) 97402; Jacob C. Larson, Eugene, OR (US)

(73) Assignee: Daniel Biagi, Eugene, OR (US)

( * ) Notice: Subject to any disclaimer, the term of this patent is extended or adjusted under 35 U.S.C. 154(b) by 572 days.

This patent is subject to a terminal disclaimer.

(21) Appl. No.: 11/204,946

(22) Filed: Aug. 15, 2005

Related U.S. Application Data

(63) Continuation-in-part of application No. 11/073,169, filed on Mar. 3, 2005, now Pat. No. 7,281,278.

(51) Int. Cl.
*E03D 11/00* (2006.01)

(52) U.S. Cl. ..... 4/255.11; 221/63

(58) Field of Classification Search ..... 4/255.01, 4/255.05, 255.11, 255.12; 221/55, 63, 312 A, 221/312 C; 242/593, 597.7
See application file for complete search history.

(56) References Cited

U.S. PATENT DOCUMENTS

| | | | | |
|---|---|---|---|---|
| 6,554,156 | B1 * | 4/2003 | Chong | 221/63 |
| 6,701,540 | B1 | 3/2004 | Gabriel | |
| 7,066,422 | B1 * | 6/2006 | Slocum | 242/593 |
| 7,281,278 | B1 * | 10/2007 | Biagi et al. | 4/255.11 |

* cited by examiner

*Primary Examiner*—Robert M Fetsuga
(74) *Attorney, Agent, or Firm*—Robert E. Howard

(57) ABSTRACT

A sanitary plunger including a hollow tubular handle shaft having a flexible force cup attached to the lower end thereof. The flexible force cup has a central opening communicating the interior of the hollow tubular handle shaft and the interior of the force cup. A distributor means allows a leading plastic protector bag to be withdrawn from the roll through the central opening of the force cup and pulled around the exterior surface of said force cup and around the lower portion of the exterior surface of said tubular handle shaft in a manner adapted to cover the interior and exterior surfaces of said force cup and the exterior of said lower portion of portion of said tubular handle shaft. A lock member holds the outer end of the bag against the outer surface of the hollow tubular handle shaft.

3 Claims, 3 Drawing Sheets

10
12
14
16
18
30
32
36
38
40
42
44
44'
45
46
50
52
54
56

SANITARY PLUNGER

CROSS-REFERENCE TO RELATED APPLICATIONS

This is a continuation-in-part of application Ser. No. 11/073,169, filed Mar. 3, 2005, now U.S. Pat. No. 7,281,278.

BACKGROUND OF THE INVENTION

The present invention relates to a toilet plunger that prevents contamination of the force cup and adjacent handle portion during use in unplugging a toilet.

The most common tool used in unplugging a toilet is a plunger. Such plungers typically have an elongated wooden handle with a rubber force cup mounted on one end thereof. In use, the rubber force cup is inserted into the toilet and into covering contact with the bowl outlet. During use the force cup and adjacent handle portion are exposed to the unsanitary material in the toilet bowl. After use the force cup and adjacent handle portion are usually rinsed in an attempt to remove unsanitary material therefrom. Such rinsing may or may not be effective in cleansing the plunger of unsanitary matter.

SUMMARY OF THE INVENTION

It is an object of the present invention to provide a toilet plunger that prevents contamination of the force cup and adjacent handle portion during use in unplugging a toilet.

The sanitary plunger includes a hollow tubular handle shaft having a flexible force cup attached to the lower end thereof. The flexible force cup has a central opening communicating the interior of the hollow tubular handle shaft and the interior of the force cup. A roll of plastic protector bags is positioned within the hollow tubular handle shaft, and distributor means are provided for withdrawing one bag at a time in a manner to envelop the interior and exterior of the force cup. Means are provided for releasably holding the outer end of a plastic protector bag against the hollow tubular handle shaft.

In one embodiment the distributor means includes a spindle and a cup shaped spreader member. The spindle includes a spindle shaft that is positioned within the hollow tubular handle shaft. The spindle shaft is adapted to receive a roll of plastic protector bags and allow the bags to be withdrawn one at a time from the exterior of the roll and over the spreader member to surround the inner and outer surface of the force cup and the lower outer portion of the hollow tubular handle shaft.

In another embodiment a roll of plastic protector bags is placed within the hollow tubular handle shaft and withdrawn one at a time from the center of the roll through a distributor that includes a slotted protector bag roll retainer member. The bag surrounds the inner and outer surface of the force cup and the lower outer portion of the hollow tubular handle shaft.

DESCRIPTION OF PREFERRED EMBODIMENTS

Figures 1, 2, 3:
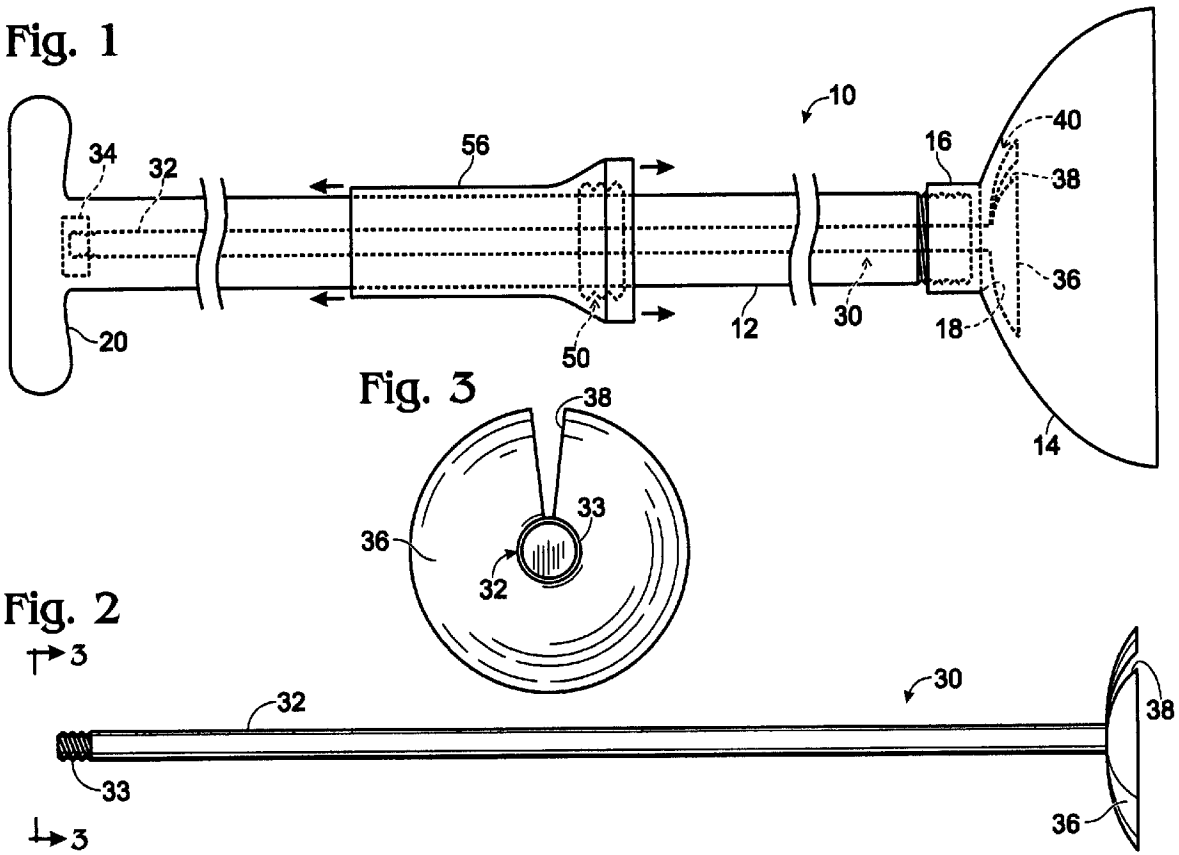
FIG. 1 is a side elevational view of the sanitary plunger of the present invention.
FIG. 2 is a side elevational view of the spindle and spindle head thereof.
FIG. 3 is a top plan view of the spindle head thereof.

The sanitary plunger 10 of the present invention includes a tubular handle shaft 12 and a flexible force cup 14 attached to the lower end of tubular handle shaft 12. The flexible force cup 14 is preferably made of rubber or rubber-like material of the type with which force cups are conventionally made. Force cup 14 has a handle receiving tubular extension 16 extending outwardly from the center thereof. The interior of tubular handle shaft 12 communicates with the interior of flexible force cup 14 via circular opening 18 that is coaxial with tubular extension 16. A hand grip 20 is attached to the upper end of tubular handle shaft 12.

A first embodiment has a distributor means that includes a spindle 30 and a cup-shaped spreader member 36.

Spindle 30 includes a spindle shaft 32 that is positioned within tubular handle 12 along the longitudinal axis thereof.

The upper end of spindle shaft 32 is threaded at 33 and adapted to be screwed into centrally threaded spider member 34. Spider member 34 is attached to the interior wall of tubular handle 12 adjacent its upper end.

A cup-shaped spreader member 36 is attached to the lower end of spindle shaft 32. Spreader member 36 has a retaining slot 38 therein, extending from the periphery thereof to adjacent the center thereof. The outer surface of spreader member 36 is spaced apart from the interior surface of force cup 14 to form an annular gap 40.

Figures 4, 5, 6:
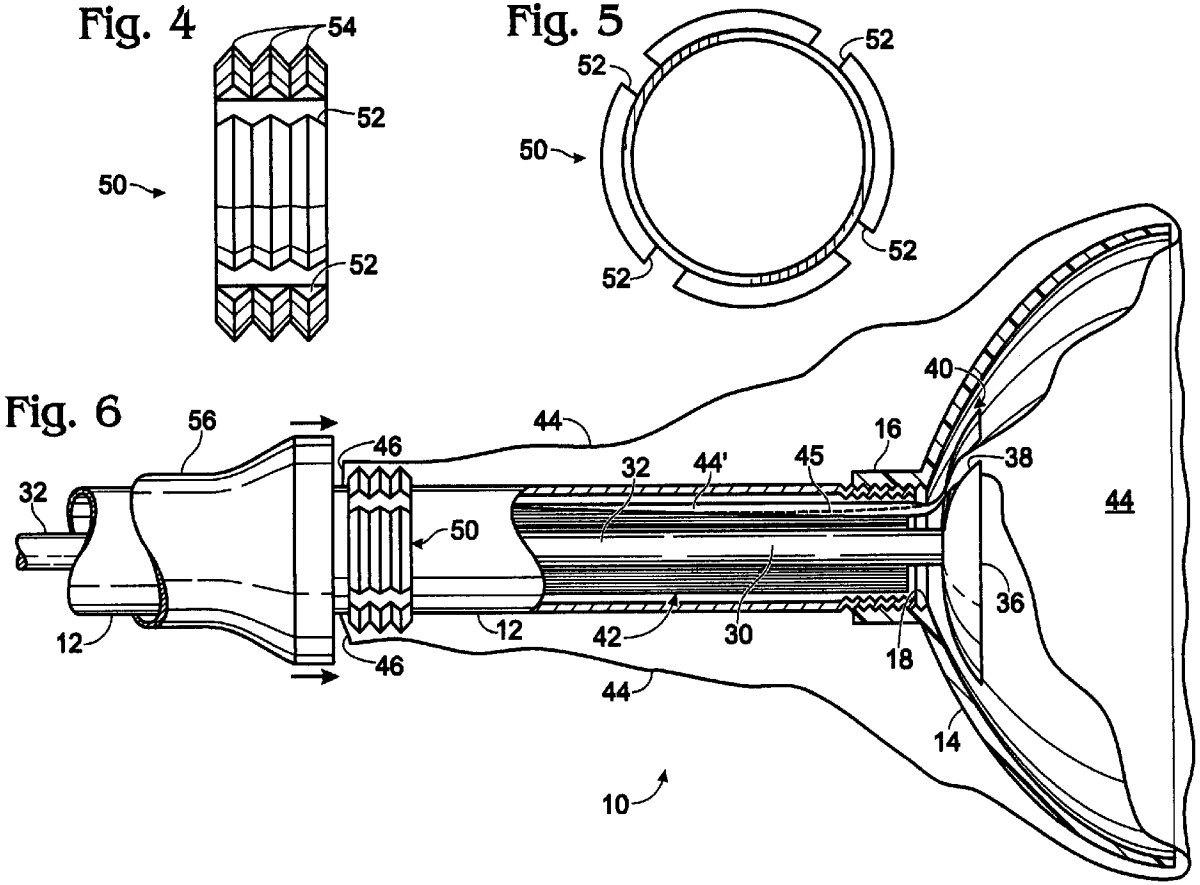
FIG. 4 is a side elevational view of the slotted holder thereof.
FIG. 5 is a top plan view of the slotted holder.
FIG. 6 is a partial elevation with cutaways, shown in partial section, of the lower portion of the sanitary plunger of a first embodiment showing the plastic bag protector in place.

As seen in FIG. 6, a roll of plastic protector bags 42 similar to those found in grocery store produce sections is positioned onto spindle shaft 32. It is preferred that the bags 42 be spirally wound on spindle shaft 32, or a cardboard tube which is placed over spindle shaft 32, with the outer bags being closest to force cup 14. Outer bag 44 is removably attached to the next adjacent bag 44' at a tear away region 45, such as by use of perforations. The outer bag 44 has an outer open end 46 that is pulled through annular gap 40 and around spreader member 36, pulled around force cup 14, and finally pulled around the lower portion of tubular handle shaft 12 until it is positioned over slotted holder 50. Slotted holder 50 is attached to the outer surface of tubular handle shaft 12 at a mid-portion thereof and has a plurality of longitudinally extending slots 52 and vertically extending slots 54.

The inner end of outer bag 44 is positioned within retaining slot 38.

Tubular lock member 56, which is adapted to slide up and down tubular handle shaft 12, is then slid downwardly over slotted holder 50 to force the outer end of the bag 44 into locking engagement therewith.

The force cup 14 and lower portion of tubular handle shaft 12 are thus covered completely by outer plastic bag 44. The plunger 10 can then be used to unclog a toilet without contact between the contents of the toilet bowl and force cup 14 and the lower portion of tubular handle shaft 12.

After use, outer plastic bag 44 is separated from the next adjacent plastic bag 44' and discarded. To ensure sanitary conditions, both outer plastic bag 44 and the next adjacent bag 44' can be removed and discarded.

Figure 7:
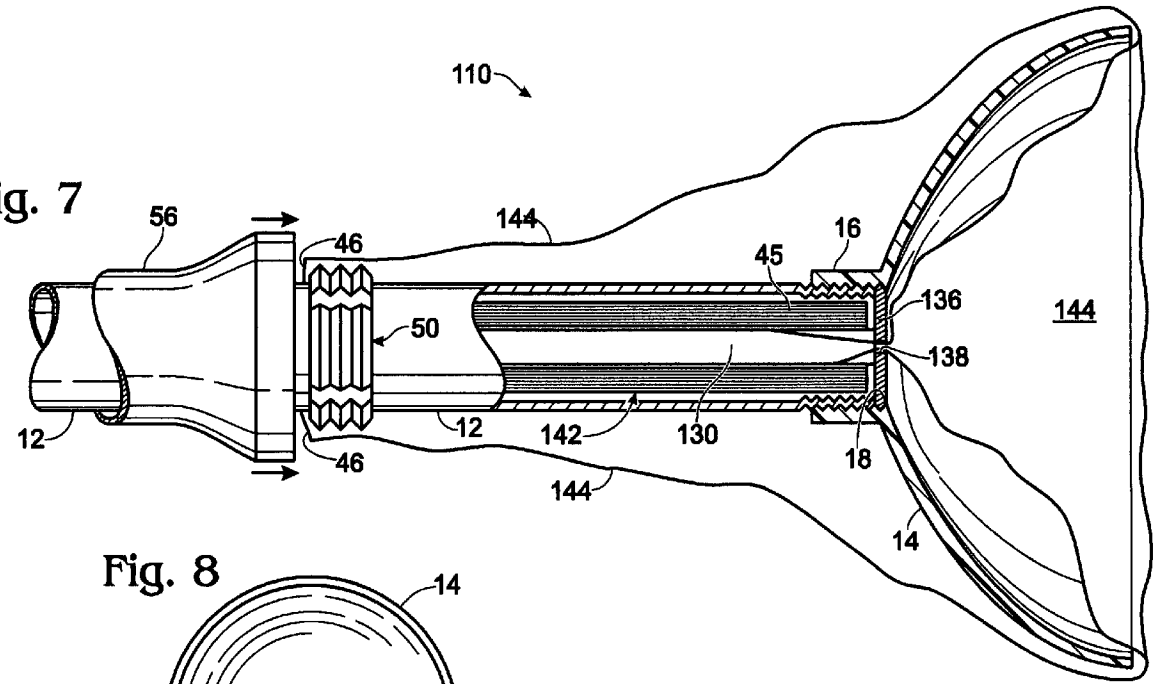
FIG. 7 is a partial elevation with cutaways, shown in partial section, of the lower portion of the sanitary plunger of a second embodiment showing the plastic bag protector in place.
Figure 8:
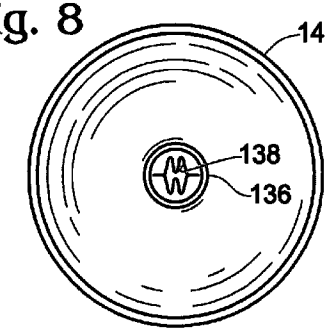
FIG. 8 is a bottom plan view of the force cup of the second embodiment showing the slotted plastic bag protector roll retainer member.

An alternative embodiment sanitary plunger 110 has a distributor means that allows omission of spindle shaft 32 and cup-shaped spreader member 36 is shown in FIGS. 7 and 8. Those elements in FIGS. 7 and 8 that are identical to those elements of FIGS. 1-6 have the same reference number and will not be re-described. A slotted protector bag roll retainer member 136 is positioned within circular opening 18 at the inner end of tubular extension 16 of force cup 14 Tubular handle 12 is removed from force cup 14 and a roll of plastic protector bags 142 of the type similar to those found in grocery store produce sections is positioned within tubular handle 12. However, the roll of plastic protector bags 142 is not wound on a core but has an open central passageway 130. The inner plastic protector bag 144 is pulled from the center of the roll of plastic protector bags 142 and threaded through slot 138 in retainer member 136. Slot 138 is generally H-shaped. Tubular handle 12 is reattached to force cup 14. Inner plastic protector bag 144 pulled around force cup 14 and around the lower portion of tubular handle shaft 12 until it is positioned over slotted holder 50. Tubular lock member 56 is then slid downwardly over slotted holder 50 to force the outer end of the bag 144 into locking engagement therewith.

Outer plastic protector bag 44 of FIG. 6 and inner plastic protector bag 144 of FIG. 7 are generically referred to hereinafter as the "leading" plastic protector bag.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A sanitary plunger comprising:

a hollow tubular handle shaft having a flexible force cup removably attached to the lower end thereof, said flexible force cup having a central opening communicating the interior of said hollow tubular handle shaft and the interior of said force cup;

said hollow tubular handle shaft adapted to receive a roll of plastic protector bags within the interior of said hollow tubular handle shaft, said roll of plastic protector bags including a plurality of individual bags having inner and outer ends, said inner and outer ends of adjacent plastic protector bags being removably connected to each other; distributor means for allowing a leading plastic protector bag to be withdrawn from said roll through said central opening of said force cup and pulled around the exterior surface of said force cup and around the lower portion of the exterior surface of said tubular handle shaft in a manner adapted to cover the interior and exterior surfaces of said force cup and the exterior of said lower portion of portion of said tubular handle shaft; and means for releasably holding the outer end of said leading plastic protector bag against the exterior of said hollow tubular handle shaft.

2. The sanitary plunger of claim 1 wherein said distributor means is a slotted protector bag roll retainer member positioned within said central opening of said force cup.

3. The sanitary plunger of claim 2 wherein slotted protector bag roll retainer member has a centrally positioned slot that is generally H-shaped.

* * * * *